US006385869B1

(12) United States Patent
Steineman et al.

(10) Patent No.: US 6,385,869 B1
(45) Date of Patent: May 14, 2002

(54) WELDMENT BOLTING SYSTEM INCLUDING A ROD BOLT DOWEL

(75) Inventors: Greg E. Steineman, Franklin; William L. Cavaiani, New Berlin, both of WI (US)

(73) Assignee: Harnischfeger Technologies, Wilmington, DE (US)

( * ) Notice: Subject to any disclaimer, the term of this patent is extended or adjusted under 35 U.S.C. 154(b) by 0 days.

(21) Appl. No.: 09/634,154

(22) Filed: Aug. 9, 2000

(51) Int. Cl.[7] ..... E02F 3/58
(52) U.S. Cl. ..... 37/397; 403/408.1
(58) Field of Search ..... 37/398, 397, 394, 37/466, 400, 395; 403/408.1

(56) References Cited

U.S. PATENT DOCUMENTS 3,735,830 A * 5/1973 Talley
4,137,816 A * 2/1979 Cartner
4,383,794 A * 5/1983 Sankey
4,474,493 A * 10/1984 Welch
5,700,105 A * 12/1997 Salice
5,810,505 A * 9/1998 Henriott et al.
5,927,413 A * 7/1999 Miyaki et al.
6,033,043 A * 3/2000 Higuchi et al.
6,074,023 A * 6/2000 Satou et al.
6,132,133 A * 10/2000 Muro et al.

* cited by examiner

*Primary Examiner*—Victor Batson
(74) *Attorney, Agent, or Firm*—James Earl Lowe, Jr.

(57) ABSTRACT

A bolting system for securing a first weldment including two spaced apart wall members, and a cross member connected to and extending between the wall members, to a second weldment including a wall member adjacent and in face to face contact with one of the first weldment wall members. The bolting system comprises a first plurality of least two openings in the one of second weldment wall member and the adjacent first weldment wall member, and a second opening in the other of the spaced apart first weldment wall members. The first plurality of openings are larger than the second opening. The bolting system further includes a rod bolt dowel in a tight fit in the first plurality of openings, the rod bolt dowel having an enlarged end which will not pass through the first plurality of openings, and having an opening through its center aligned with the second opening. The bolting system further includes a rod bolt loosely fitted in the rod bolt dowel opening and in the second opening, the rod bolt having a nut on the first end providing an enlargement that will not pass through either the rod bolt dowel opening or the second opening, and a nut releasably secured to the other end of the rod bolt and providing an enlargement that will not pass through either the rod bolt dowel opening or the second opening.

6 Claims, 3 Drawing Sheets

WELDMENT BOLTING SYSTEM INCLUDING A ROD BOLT DOWEL

BACKGROUND OF THE INVENTION

This invention is directed to a bolting system for securing a first weldment including two spaced apart wall members, and a cross member connected to and extending between the wall members, to a second weldment including a wall member adjacent and in contact with one of said first weldment wall members. Still more particularly, this invention is directed to electric mining shovel car body-crawler frame bolted-joint designs.

Electric mining shovels, through field service history, have had difficulty with car body-crawler frame bolted-joint designs. Relative movements between the car body and crawler frame mounting faces have promoted and contributed to premature structural fatigue cracking in the car body shear ledge. The subsequent repair of the car body structure is generally very time and labor consuming.

Current car body-crawler frame bolted-joint designs rely solely on fastener tension to attempt to hold the joint together and to prevent movement within the joint. But slippage at the interface between the car body and the crawler frame still occurs.

SUMMARY OF THE INVENTION

This invention provides a bolting system for securing a first weldment including two spaced apart wall members, and a cross member connected to and extending between the wall members, to a second weldment including a wall member adjacent and in face to face contact with one of the first weldment wall members. The bolting system comprises a first plurality of at least two openings in the one of second weldment wall member and the adjacent first weldment wall member, and a second opening in the other of the spaced apart first weldment wall members. The first plurality of openings are larger than the second opening. The bolting system further includes a rod bolt dowel in a tight fit in the first plurality of openings, the rod bolt dowel having an enlarged end which will not pass through the first plurality of openings, and having an opening through its center aligned with the second opening. The bolting system further includes a rod bolt loosely fitted in the rod bolt dowel opening and in the second opening, the rod bolt having a nut on the first end providing an enlargement that will not pass through either the rod bolt dowel opening or the second opening, and a nut releasably secured to the other end of the rod bolt and providing an enlargement that will not pass through either the rod bolt dowel opening or the second opening.

In one embodiment, the first weldment wall member has a top, and wherein the second weldment wall member has a top shear ledge that sits on top of the one first weldment wall member top.

One of the objects of this invention is to provide a reliable car body-crawler frame bolted-joint design which can be easily assembled by field erection crews, and which can be modified, without substantial rework cost, if assembly difficulties should arise. More particularly, one of the objects of this invention is to provide a bolting system including a dowel that can be remachined to provide a desired precision fit. Also, if the dowel or an opening through the car body or crawler frame should wear, new or oversize dowels can be installed to maintain the desired fit. And, if the dowel should fail, the system could continue to serve its intended function, until such time as when repairs can be made by the customer.

Another of the objects of this invention is to provide a bolting system that provides the soundness and security of a doweled interface with a combination bolt and tapered-flanged dowel that can be assembled together, without additional installation tooling.

Figure 1:
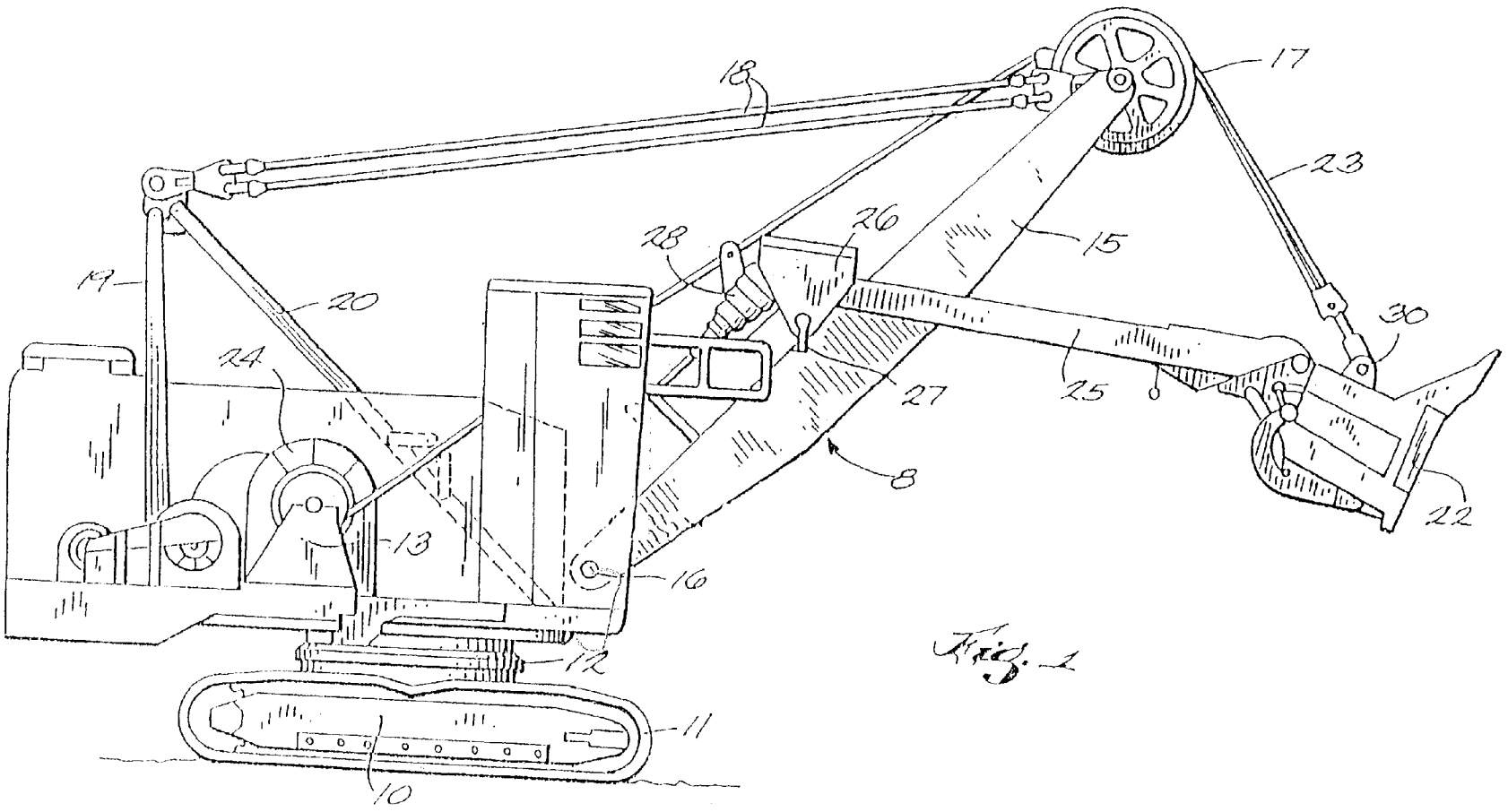
FIG. 1 is a plan view of a surface mining shovel.

Before one embodiment of the invention is explained in detail, it is to be understood that the invention is not limited in its application to the details of the construction and the arrangements of components set forth in the following description or illustrated in the drawings. The invention is capable of other embodiments and of being practiced or being carried out in various ways. Also, it is to be understood that the phraseology and terminology used herein is for the purpose of description and should not be regarded as limiting. Use of "including" and "comprising" and variations thereof as used herein is meant to encompass the items listed thereafter and equivalents thereof, as well as additional items. Use of "consisting of" and variations thereof as used herein is meant to encompass only the items listed thereafter and equivalents thereof.

DESCRIPTION OF A PREFERRED EMBODIMENT OF THE INVENTION

This invention is a bolting system 40 (see FIG. 3) for securing a first weldment 44 including two spaced apart wall members 48 and 52, and a cross member 56 connected to and extending between the wall members 48 and 52, to a second weldment 60 including a wall member 64 adjacent and in face to face contact with the first weldment wall members 48. More particularly (see FIG. 3), a plurality of cross members 56 are connected to and extending between the wall members 48 and 52. Still more particularly, this invention is directed to an electric mining shovel 8 (see FIG. 1) and to a car body-crawler frame bolted-joint system 40. In this embodiment, the first weldment 44 is the crawler frame and the second weldment 60 is the car body.

The power shovel 8 includes a platform in the form of a machinery deck 13, and an upwardly extending boom 15 connected at the lower end 16 to the platform 13, and a sheave 17 at the top of the boom 15. The dipper 22 is suspended from the boom 15 by a hoist rope 23 trained over the sheave 17 and attached to the dipper 22 at a bail pin 30. The machine structure is movable to locate the dipper 22 in respective loaded and unloading positions. More particularly, the structure is mounted on a turntable 12, and the turntable 12 is mounted on the car body 60.

Referring to FIG. 1 the power shovel depicted therein of the well known construction commonly referred to as a rope shovel. This shovel loader comprises a mobile base 10 supported on drive tracks 11, and having supported thereon through the turntable 12, the machinery deck 13. The turntable 12 permits full 360° rotation of the machinery deck relative to the base. The drive tracks 11 are supported by the crawler frame 44.

The boom 15 is pivotally connected at 16 to the machinery deck 13. The boom 15 is held in a upwardly and outwardly extending relation to the deck by a brace in the form of tension cables 18 which are anchored to a back stay of a stay structure 20 rigidly mounted on the machinery deck 13.

The dipper 22 is suspended by the hoist rope or cable 23 from the sheave 17, the hoist rope being anchored to a winch drum 24 mounted on the machinery deck 13. As the winch drum rotates, the hoist rope 23 is either paid out or pulled in, lowering or raising the dipper 22. The dipper has a handle 25 rigidly attached thereto, with the dipper handle 25 slidably supported in a saddle block 26, which is pivotally mounted on the boom 15 at 27. The dipper handle has a rack tooth formation thereon (not shown) which engages a drive pinion (not shown) mounted in the saddle block 26. The drive pinion is driven by an electric motor and transmission unit 28 to effect extension or retraction of the dipper handle 25 relative to the saddle block 26.

A source of electrical power (not shown) is mounted on the machinery deck 13 to provide power to one or more hoist electric motors (not shown) which drives the winch drum 24, a crowd electric motor (not shown) which drives the saddle block transmission unit 28, and a swing electric motor (not shown) which turns the machinery deck turntable 12. The above described basic construction of the shovel loader is widely known and used and further details of the construction are not provided as they are well known in the art.

Figure 2:
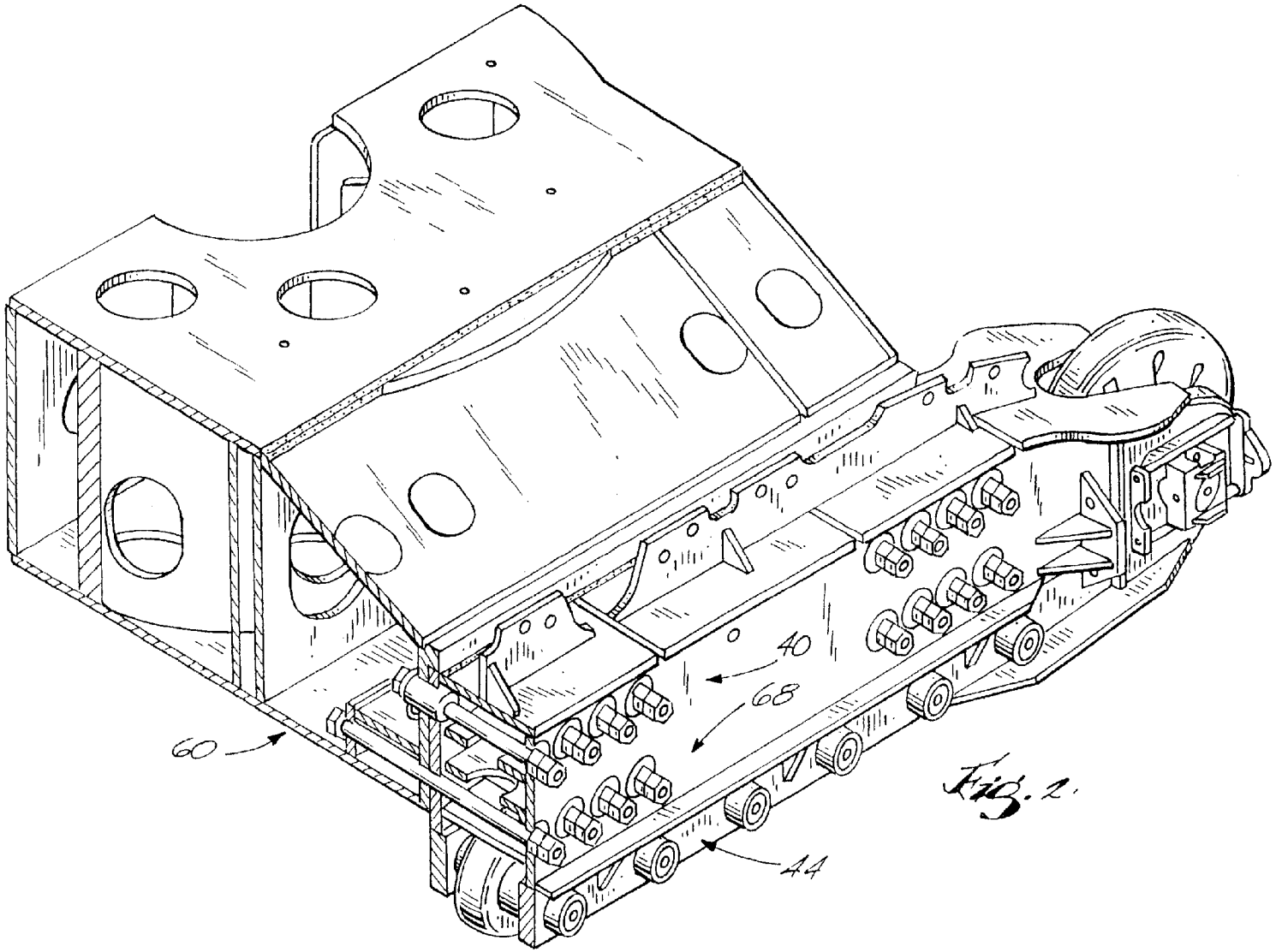
FIG. 2 is a perspective view of part of a crawler frame attached to a power shovel car body by the bolting system of this invention.
Figure 3:
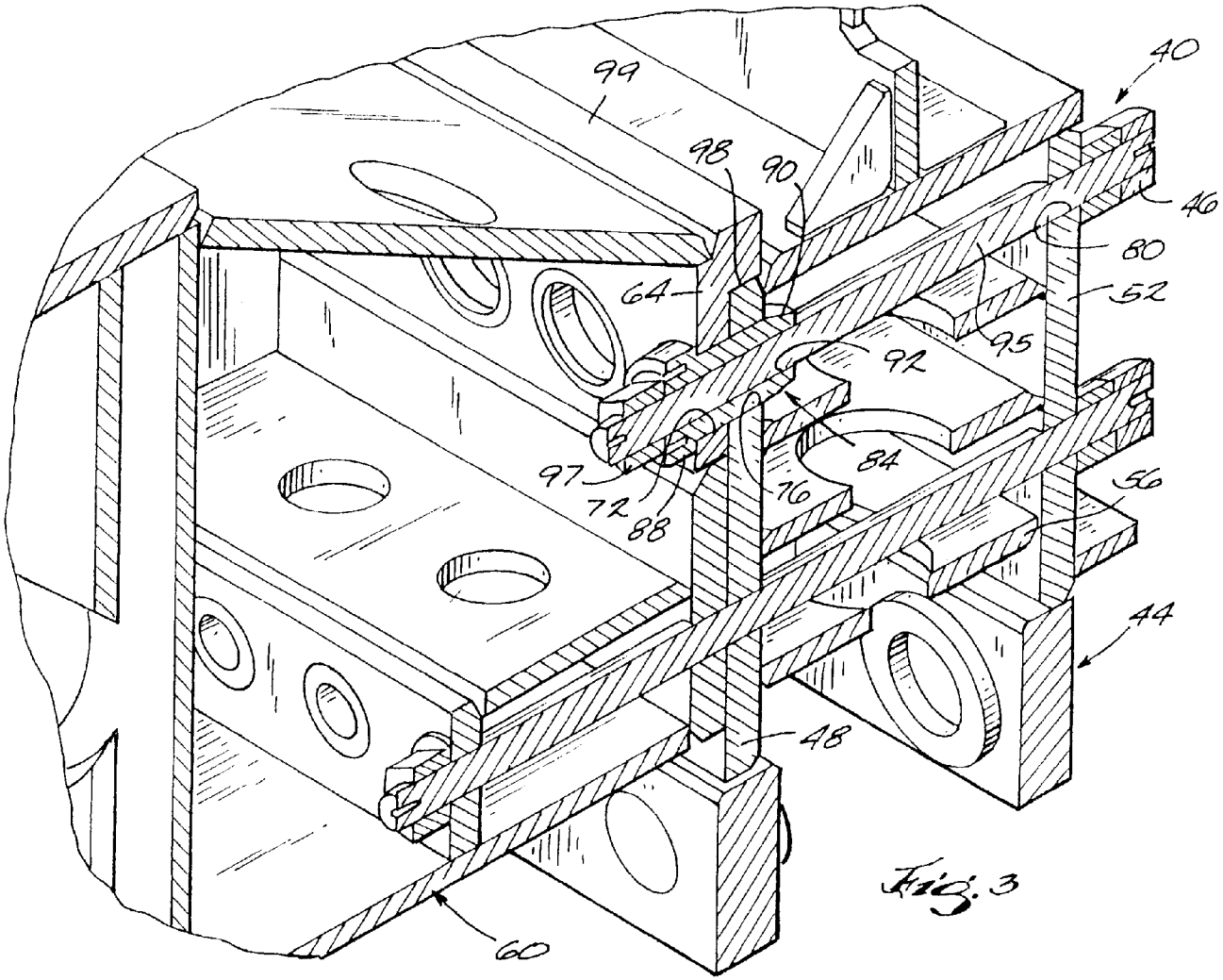
FIG. 3 is a closer perspective view of part of the end of the crawler frame attached to the power shovel car body shown in FIG. 2.

As shown in FIG. 2, a plurality of bolting systems 40 secures the crawler frame 44 to the car body 60. More particularly, nearly all of one crawler frame 44 and one half of the car body 60 are shown, and in the pieces shown eight of the new bolting system 40 of this invention secures the top of the crawler frame 44 to the car body 60, and eight conventional bolting systems 68 secure the bottom of the crawler frame 44 to the car body 60. As shown in FIG. 3, each of the bolting systems 40 comprises a first plurality of at least two openings 72 and 76 in the one crawler frame wall member 48 and the adjacent car body wall member 64, and a second opening 80 in the other 52 of the spaced apart crawler frame wall members. The first plurality of openings 72 and 76 are larger than the second opening 80.

The bolting system 40 further includes a rod bolt dowel 84 in a tight fit in the first plurality of openings 72 and 76, the rod bolt dowel 84 having an enlarged end 88 which will not pass through the first plurality of openings 72 and 76, and having an opening 92 through its center aligned with the second opening 80. The rod bolt dowel other end 90 is tapered to aid in assembly of the rod bolt dowel 84 into the first plurality of openings 72 and 76. Further, when the rod bolt dowel 84 is torqued into the openings 72 and 76, the rod bolt dowel 84 aids in bringing the openings 72 and 76 into alignment.

The bolting system 40 further includes a rod bolt 95 more loosely fitted in the rod bolt dowel opening 92 and in the second opening 80, the rod bolt 95 having first means in the form of a nut 96 on the first end providing an enlargement that will not pass through either the rod bolt dowel opening 92 or the second opening 80, and second means in the form of a nut 97 releasably secured to the other end of the rod bolt and providing an enlargement that will not pass through either the rod bolt dowel opening 92 or the second opening 80.

In one embodiment, the one crawler frame wall member has a top 98, and the car body wall member has a top shear ledge 99 that sits on top of the one crawler frame wall member top 98.

The precision-fitted dowel-rod bolt system provides superior joint integrity and control of relative joint movements during machine service. This new system, unlike conventional systems, no longer relies solely on frictional forces generated by fastener tension to prevent movement within the joint. Hence, the old problem of slippage at the interface between car body and crawler frame has been eliminated. Also, this new system significantly reduces (by nearly an estimated 40%) the damaging stresses seen by the car body wall member shear ledge, over the current system when new, and the resulting likelihood of premature fatigue cracking of the ledge, during machine service. In addition, simplification of the crawler frame structure, over the current crawler frame designs, is possible with the new system. Because of the dowel system's ability to transmit propel forces to the rest of the machine, the old protruding "wraparound" structure at the rear-inside of the crawler frame, and the corresponding bolted-joint at the rear of the car body, could be eliminated.

What is claimed is:

1. A bolting system for securing a first weldment including two spaced apart wall members, and a cross member connected to and extending between said wall members, to a second weldment including a wall member adjacent and in face to face contact with one of said first weldment wall members, said bolting system comprising a first plurality of at least two openings in said second weldment wall member and said adjacent one of said first weldment wall members, and a second opening in the other of said spaced apart first weldment wall members, said first plurality of openings being larger than the second opening, a rod bolt dowel in a tight fit in said first plurality of openings, said rod bolt dowel having an enlarged end which will not pass through said first plurality of openings, and having an opening through its center aligned with said second opening, a rod bolt loosely fitted in said rod bolt dowel opening and in said second opening, the rod bolt having first end means on one end of the rod bolt providing an enlargement that will not pass through either said rod bolt dowel opening or said second opening, and second end means releasably secured to the other end of the rod bolt and providing an enlargement that will not pass through either said rod bolt dowel opening or said second opening.

2. A bolting system in accordance with claim 1 wherein said one first weldment wall member has a top, and wherein said second weldment wall member has a top shear ledge that sits on top of the one first weldment wall member top.

3. A bolting system in accordance with claim 1 wherein said rod bolt dowel other end is tapered.

4. A power shovel including a crawler frame including two spaced apart wall members, and a cross member connected to and extending between said wall members, a car body including a wall member adjacent and in face to face contact with one of said crawler frame wall members, and a plurality of bolting systems securing the crawler frame to the car body, each bolting system including a first plurality of at least two openings in said one crawler frame wall member and said adjacent car body wall member, and a second opening in the other of said spaced apart crawler frame wall members, said first plurality of openings being larger than the second opening, a rod bolt dowel in a tight fit in said first plurality of openings, said rod bolt dowel having an enlarged end which will not pass through said first plurality of openings, and having an opening through its center aligned with said second opening, a rod bolt loosely fitted in said rod bolt dowel opening and in said second opening, the rod bolt having first end means on one end of the rod bolt providing an enlargement that will not pass through either said rod bolt dowel opening or said second opening, and second end means releasably secured to the other end of the rod bolt and providing an enlargement that will not pass through either said rod bolt dowel opening or said second opening.

5. A power shovel in accordance with claim 4 wherein said one wall member has a top, and wherein said other wall member has a top shear ledge that sits on top of the one wall member top.

6. A power shovel in accordance with claim 4 wherein said rod bolt dowel other end is tapered.

* * * * *